US007992367B2

(12) United States Patent
Streifel et al.

(10) Patent No.: US 7,992,367 B2
(45) **Date of Patent: *Aug. 9, 2011**

(54) FLEXIBLE FORWARD SUBSTRATE FOR A TREELESS WESTERN SADDLE

(75) Inventors: Louis Paul Streifel, Washougal, WA (US); Carole Elise Weidner, Washougal, WA (US)

(73) Assignee: Ansur Saddlery Northwest, LLC, Washougal, WA (US)

(*) Notice: Subject to any disclaimer, the term of this patent is extended or adjusted under 35 U.S.C. 154(b) by 0 days.

This patent is subject to a terminal disclaimer.

(21) Appl. No.: 12/605,091

(22) Filed: Oct. 23, 2009

(65) Prior Publication Data

US 2010/0083623 A1 Apr. 8, 2010

Related U.S. Application Data

(63) Continuation of application No. 11/737,718, filed on Apr. 19, 2007, now Pat. No. 7,628,002.

(51) Int. Cl.
*B68C 1/02* (2006.01)

(52) U.S. Cl. ..... 54/44.1

(58) Field of Classification Search ..... 54/44.1, 54/44.7

See application file for complete search history.

(56) References Cited

U.S. PATENT DOCUMENTS

| | | | | |
|---|---|---|---|---|
| 105,080 | A * | 7/1870 | Horter | 54/44.7 |
| 318,610 | A * | 5/1885 | Fink | 54/44.1 |
| 864,679 | A * | 8/1907 | Nelson et al. | 54/44.1 |
| 1,212,545 | A * | 1/1917 | Nickel | 54/44.7 |
| 2,008,977 | A * | 7/1935 | Connolly | 54/44.1 |
| 6,272,817 | B1 * | 8/2001 | Further | 54/44.1 |
| 6,434,915 | B1 * | 8/2002 | DeCosemo | 54/44.1 |
| 7,628,002 | B2 * | 12/2009 | Streifel et al. | 54/44.1 |

* cited by examiner

*Primary Examiner* — Robert Swiatek
(74) *Attorney, Agent, or Firm* — Rylander & Associates, PC

(57) ABSTRACT

A treeless western saddle comprising a flexible base coupled to an underside of a flexible substrate. A seat section is integrally formed in the flexible substrate. A pommel section is integrally formed in the flexible substrate. The flexible base has an upper stirrup aperture and a lower stirrup aperture formed in a lateral side of the flexible base. The underside of the flexible substrate has a cavity formed in a lateral side of the underside of the flexible substrate, the cavity to extend from the upper stirrup aperture to at least the lower stirrup aperture.

2 Claims, 6 Drawing Sheets

FLEXIBLE FORWARD SUBSTRATE FOR A TREELESS WESTERN SADDLE

CROSS-REFERENCE TO RELATED APPLICATION

This application is a continuation of and claims priority to application Ser. No. 11/737,718, filed 19 Apr. 2007, which issued as U.S. Pat. 7,628,002 on Dec. 8, 2009 and which is herein incorporated by reference.

FIELD OF THE INVENTION

Embodiments of the present invention relate generally to the field of saddlery and, in particular, to a treeless western saddle.

BACKGROUND

Modern saddles are designed around a rigid frame called a saddletree. Saddletrees are typically constructed of a nonflexible material such as wood, metal, plastic, or fiberglass. Although these rigid saddletrees may provide an ample basis of support and stability for a rider seated in a saddle, the rigidity may often result in pain or even injuries to the horse carrying the saddle and the rider.

Treeless saddles have recently been developed to address the above concerns. While treeless saddles may not have the same disabling characteristics of traditional treed saddles, providing a treeless saddle with the desired rider support and stability may be a challenge in its design.

SUMMARY

Embodiments related to a flexible forward substrate for a treeless western saddle are described herein. Other embodiments may be described and claimed.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

In the following detailed description, reference is made to the accompanying drawings which form a part hereof wherein like numerals designate like parts throughout, and in which are shown, by way of illustration, specific embodiments in which the invention may be practiced. It is to be understood that other embodiments may be utilized and structural changes may be made without departing from the scope of the present invention. Therefore, the following detailed description is not to be taken in a limiting sense, and the scope of the present invention is defined by the appended claims and their equivalents.

Reference in the specification to "one embodiment" or "an embodiment" means that a particular feature, structure, or characteristic described in connection with the embodiment is included in at least one embodiment. The appearances of the phrase "in one embodiment" in various places in the specification do not necessarily all refer to the same embodiment, but they may.

The phrase "A and/or B" means (A), (B), or (A and B). The phrase "A, B, and/or C" means (A), (B), (C), (A and B), (A and C), (B and C) or (A, B and C).

The description may use perspective-based language such as up/down, back/front, and top/bottom. Such language is merely used to facilitate the discussion and is not intended to restrict the application of embodiments of the present invention.

Embodiments of the present invention include a treeless western saddle having a flexible, nonrigid construction. The components and structure of such a saddle, to be described in detail below, allow for provision of support and stability to a rider utilizing the saddle without at least some of the shortcomings associated with prior art saddles with rigid saddletrees described above.

Figure 1:
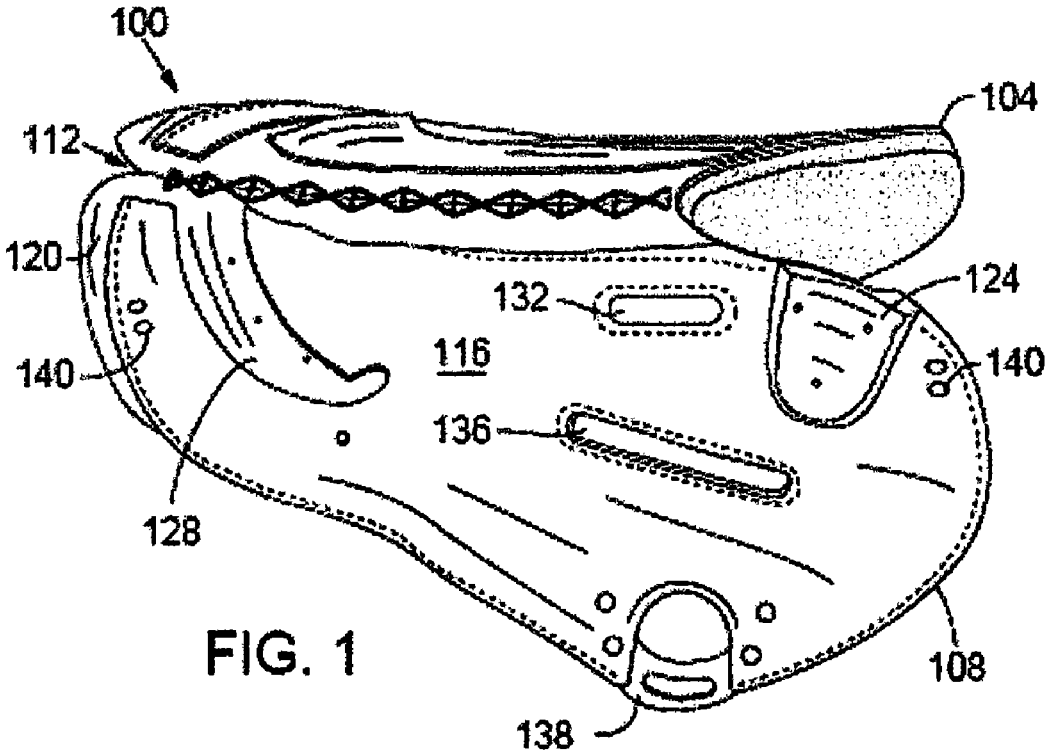
FIG. 1 is a top perspective view of a saddle base in accordance with various embodiments of the present invention.

FIG. 1 illustrates a saddle base 100 in accordance with various embodiments of the present invention. The saddle base 100 may include a first portion 104 coupled to a second, symmetrical portion 108. The first and second portions 104 and 108 may be coupled, e.g., sewn, together at a seam that runs along a central axis 112 of the saddle base 100. The saddle base 100 may be constructed of nonrigid, flexible materials such as leather or other suitable materials. Much of the description hereinafter may be relative to the portion 108; however, the symmetry of the saddle may imply similar structural details with respect to the portion 104.

In some embodiments a rigging 116 may be coupled to a top surface 120 of the portion 108. The rigging 116 may be of a higher quality material than the underlying material of the portion 108 in order to provide a more refined appearance. The rigging 116 may include cutouts 124 and 128 that may allow for pommel and cantle structures (to be described below) to be coupled directly to the underlying portion 108.

The portion 108 may include a pair of stirrup leather apertures, e.g., apertures 132 and 136, that go through to a bottom surface of the portion 108. A stirrup leather strap (not shown in this figure) may be looped through the apertures 132 and 136 to secure the stirrup leathers to the saddle base 100. The upper aperture 132 may generally serve as an axis of rotation for the stirrup leathers and, therefore, the lower aperture 136 may be longer than the upper aperture 132 to provide for rotation around a given moment arm (e.g., distance between apertures 132 and 136).

The portion 108 may also include a saddle ring 138. The saddle ring 138 may be a metal ring designed as an anchor point for a cinch strap (not shown). Embodiments having a rigid, e.g., metallic, saddle ring 138 may not detract from the overall flexible nature of the saddle base 100 as it is a localized, discrete element. Furthermore, given that the saddle ring 138 is located on a lower perimeter of the portion 108 it will not be pushed into the horse's back by the weight of the rider.

The portion 108 may further include panel strap apertures 140 to facilitate securement of panels to the saddle base 100 as will be described below.

Figure 2:
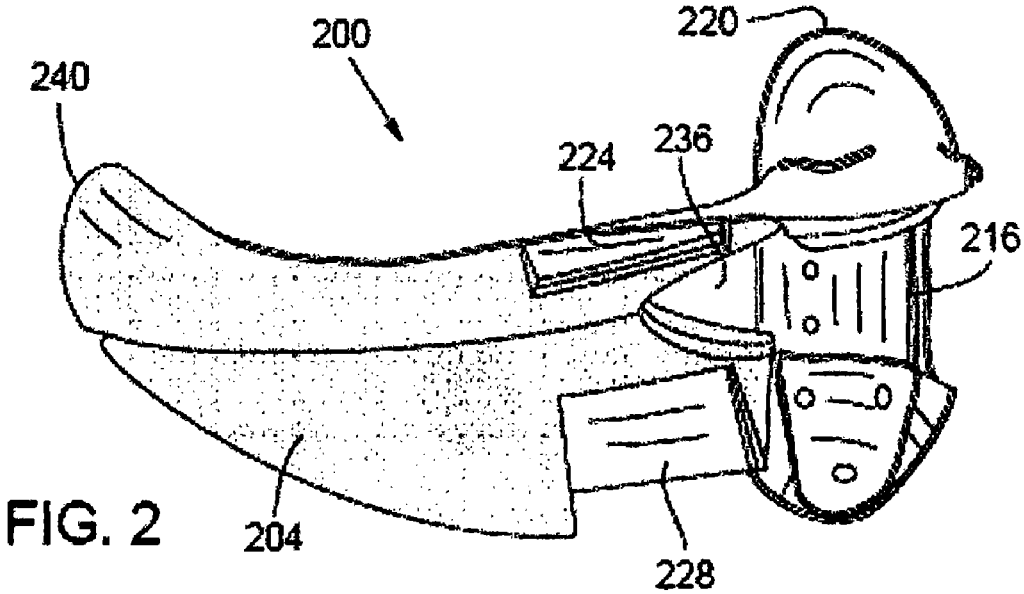
FIG. 2 is a bottom perspective view of a flexible forward substrate in accordance with various embodiments of the present invention.
Figure 3:
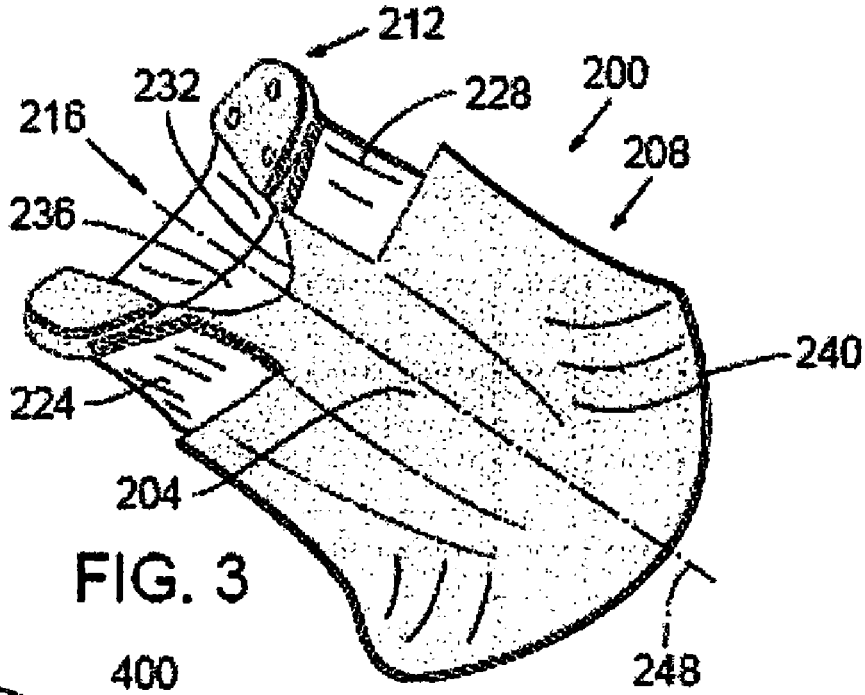
FIG. 3 is another bottom perspective view of the flexible forward substrate in accordance with various embodiments of the present invention.

FIGS. 2 and 3 provide perspective views of a flexible forward substrate 200 in accordance with an embodiment of the present invention. In particular, FIGS. 2 and 3 provide a perspective view primarily showing an undersurface 204 of the flexible forward substrate 200.

The flexible forward substrate 200 may have a seat section 208, which may extend rearwardly from a pommel section 212. The pommel section 212 may have an arch 216 and a ridge 220 that extends substantially perpendicular to the central axis 112.

The pommel section 212 and the seat section 208 may be integrally formed with one another. As used herein, integrally formed may refer to components being coupled together through integration of one component into another component or through the formation of a single element with the components merely being parts of the single element.

For example, in some embodiments the flexible forward substrate 200 may be composed of a nonrigid material such as a foam rubber compound, e.g., a polyurethane elastomer. In these embodiments the pommel section 212 and the seat section 208 may be integrally formed through construction of the flexible forward substrate 200 as a single molded piece. That is, the flexible forward substrate 200 is one cohesive unit without structural separation between the pommel section 212 and the seat section 208.

The undersurface 204 of the flexible forward substrate 200 may include a pair of cavities, e.g., cavity 224 and cavity 228. The cavity 224 may correspond to a stirrup leather aperture of the portion 108, e.g., upper aperture 132, to provide clearance for accommodating a stirrup leather strap. Similarly, the cavity 228 may correspond to astirrup leather aperture of the portion 104.

The seat section 208 may also have a cutout 232 that, in conjunction with the arch 216, forms a center aperture 236 of the flexible forward substrate 200. The center aperture 236 may be at the forward portion of the saddle.

The flexible forward substrate 200 may further have a rearward edge 240 that is configured to complement a cantle when the flexible forward substrate 200 and cantle are both secured to the saddle base 100.

The seat section 208 may be solid throughout a majority of a central axis 248 running through the seat section 208, which may correspond to the central axis 112 of the saddle base 100. As used herein, "solid" may refer to the lack of interior through holes and does not intend to imply any limitation of compactness and/or density. As shown in FIGS. 2 and 3 the seat section 208 is solid along the central axis 248 from the rearward edge 240 to the center aperture 236. The solid nature of the seat section 208 may provide a variety of advantages including, but not limited to, facilitating a distribution of the weight of a rider over an extended area of the saddle base 100 and, ultimately, a horse's back; providing an increased area in which the flexible forward substrate 200 may be secured to the saddle base 100; and increasing the overall structural cohesiveness of the various components of the saddle.

Figure 4:
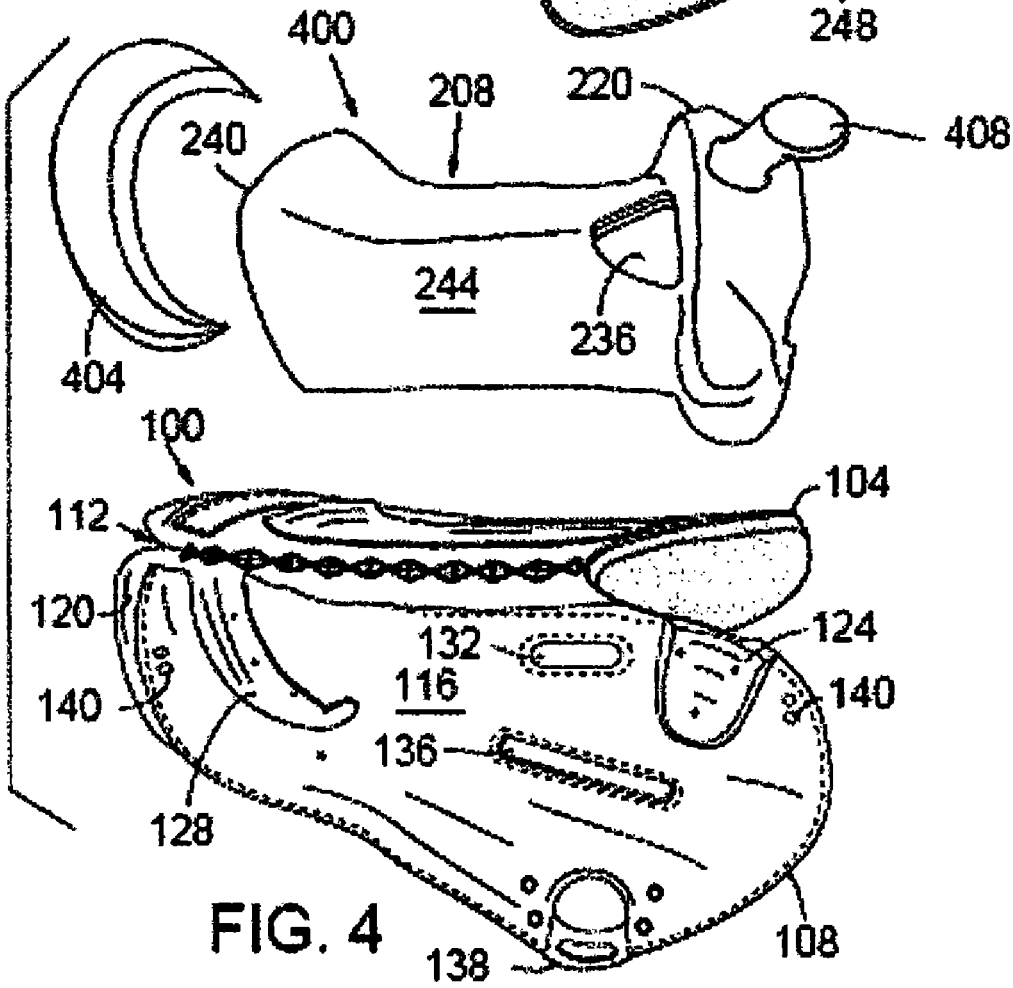
FIG. 4 is an exploded view of components of a saddle structure in accordance with various embodiments of the present invention.
Figure 5:
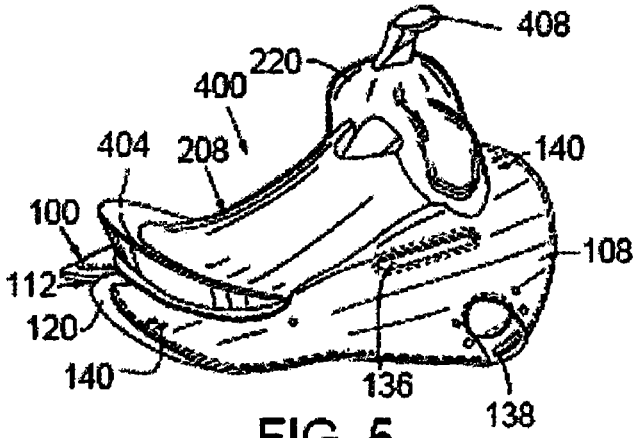
FIG. 5 is a combined view of the saddle structure in accordance with various embodiments of the present invention.

FIGS. 4 and 5 respectively illustrate exploded and assembled views of a saddle structure 400 in accordance with various embodiments of the present invention. The saddle structure 400 may include the flexible forward substrate 200, the saddle base 100, and a cantle 404. A top surface 244 of the flexible forward substrate 200, opposite the undersurface 204 shown in FIG. 3, is shown in these figures.

In some embodiments, a horn 408 may be coupled to the flexible forward substrate 200 at the pommel section 212 and, in particular, on an apex of the ridge 220 along the central axis of the saddle. The horn 408 may be integrally formed with the pommel section 212.

Figure 6:
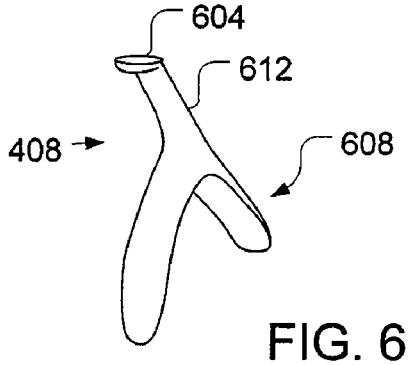
FIG. 6 is a perspective view of a saddle horn in accordance with various embodiments of the present invention.

FIG. 6 illustrates the horn 408 in accordance with various embodiments of the present invention. The horn 408 may be a solid component molded of a foam rubber material that may be denser than the material used in the construction of the flexible forward substrate 200. The increased density of the horn 408 may decrease its flexibility; however, this may be permitted by the fact that the horn 408 will not bear the weight of a rider during normal functions of the saddle.

The horn 408 may include a cap 604 and an anchor 608 coupled to one another through a neck 612. The anchor 608 may include two arms that may be embedded within the pommel section 212 when it is formed, thereby providing integral formation of the horn 408 and pommel section 212. In other embodiments, other coupling arrangements may be used.

Referring again to FIG. 4, the cantle 404 may be a component constructed of a flexible, nonrigid material that may be similar to that of the flexible forward substrate 200. The cantle 404 may be secured to the saddle base 100 at the location of the cutout 128 by one or more fastening devices, e.g., bolts screwing into anchors, such as t-nuts, embedded in the cantle 404. In other embodiments, additional/alternative mechanisms for securing the cantle 404 to the saddle base 100 may be employed.

In a similar manner, the flexible forward substrate 200 may be secured to the saddle base 100 at the location of the cutout 124. The undersurface 204 of the flexible forward substrate 200 may additionally be attached to the top surface 120 (of the saddle base 100) and the cantle 404 with, e.g., an adhesive and/or stitching. Upon attachment of the flexible forward substrate 200 to the saddle base 100 the cavity 224 may be aligned with the stirrup leather apertures 132 of the portion 108 and cavity 228 may be aligned with a stirrup leather aperture of the portion 104.

Figure 7:
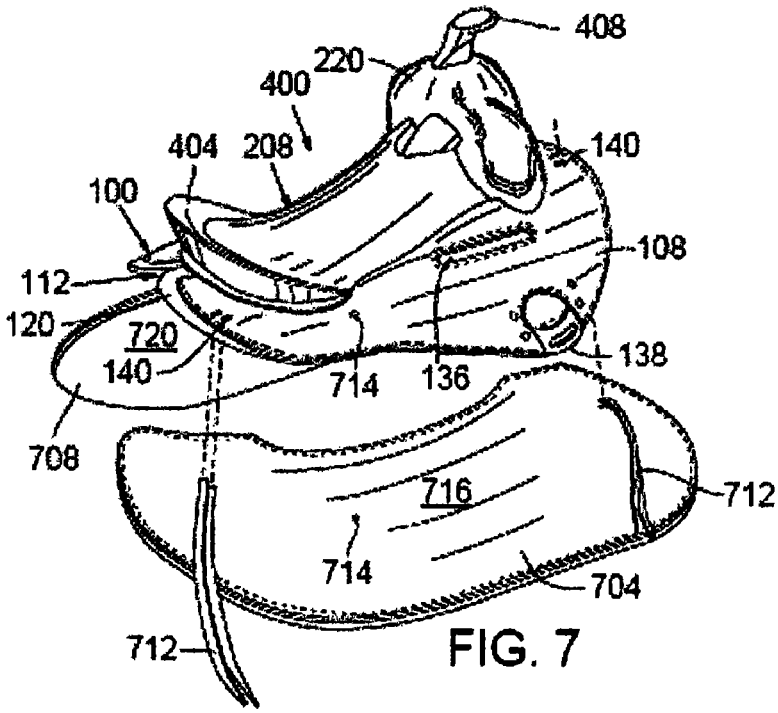
FIG. 7 is a partially exploded view of panels being coupled to the saddle structure in accordance with various embodiments of the present invention.
Figure 8:
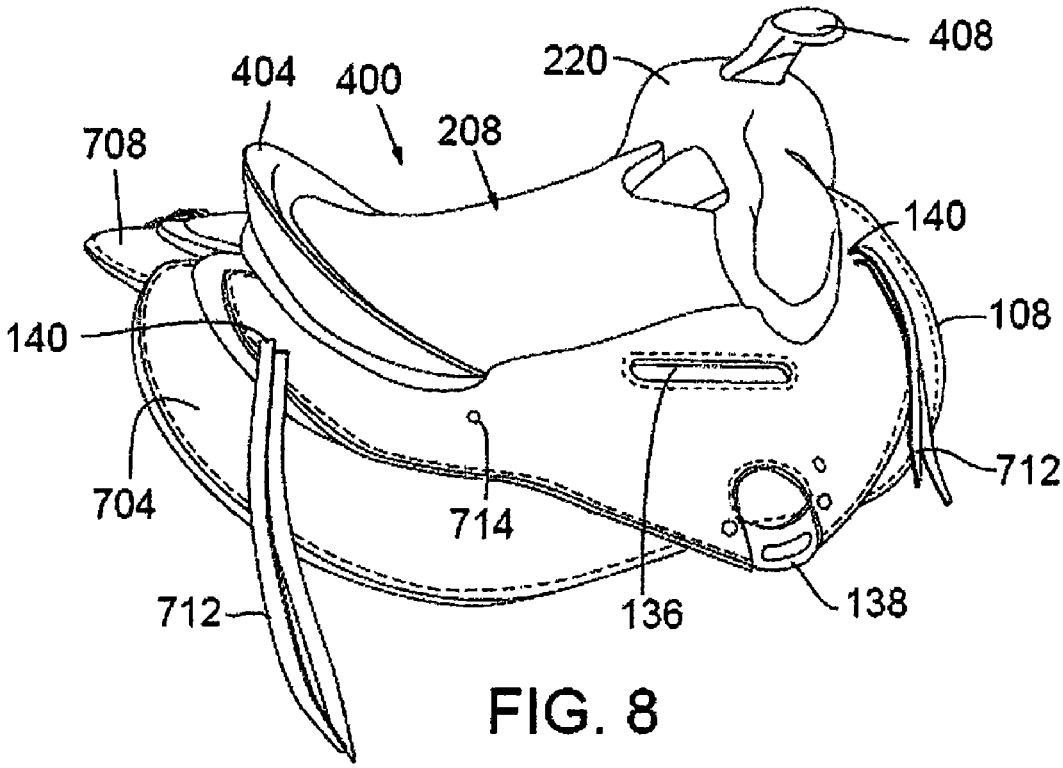
FIG. 8 is a combined view of the saddle structure and the panels in accordance with various embodiments of the present invention.

FIGS. 7 and 8 respectively illustrate exploded and assembled views of the saddle structure 400 and panels 704 and 708 in accordance with various embodiments of the present invention. Panel 704 may be coupled to the saddle base 100 through panel straps 712 being directed through respective panel strap apertures 140. Fastening devices, e.g., bolts, screws, etc., may be directed through fastening apertures 714 in the saddle base 100 and the panel 704 to facilitate this coupling. Panel 708 may coupled to the saddle base 100 in a similar manner.

The panels 704 and 708 may be constructed of one or more layers of various materials to provide desired functionality. For example, a top surface 716 of panel 704 may be a leather layer, underlaid by a trauma absorption layer of, e.g., rubber, which, in turn, may be underlaid by a cushioning layer (e.g., shown on an undersurface 720 of panel 708) of, e.g., sheepskin. The cushioning layer may provide a variety of functions such as, but not limited to, facilitating the absorption of moisture, providing breathability, prohibiting heat buildup, etc.

In various embodiments, the combination of the trauma absorption layer and the cushioning layer (along with the general flexible nature of the saddle structure 400) may also work to protect both the horse and rider from trauma that may otherwise result from the jarring motion of riding.

Figure 9:
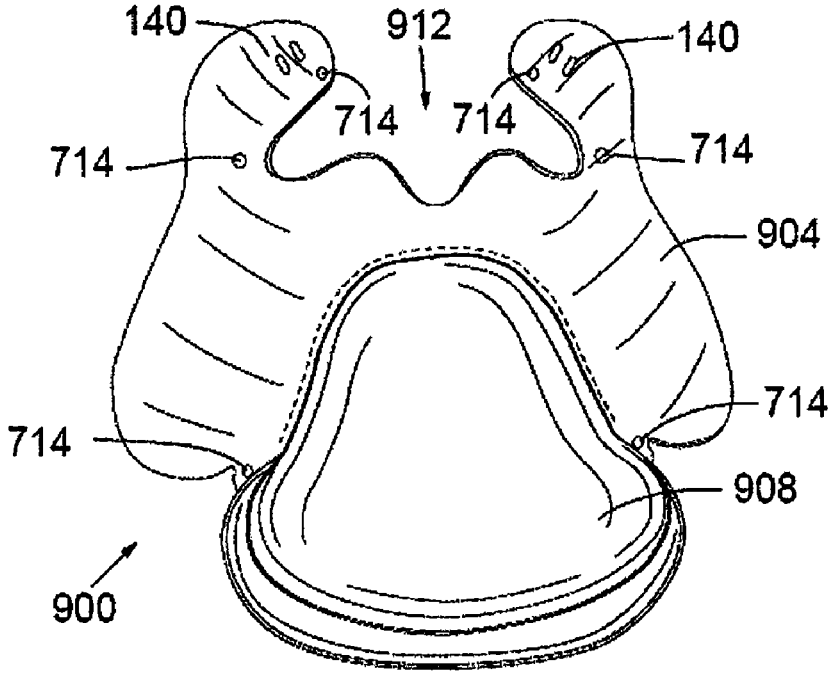
FIG. 9 is a top view of a saddle cover in accordance with various embodiments of the present invention.
Figure 10:
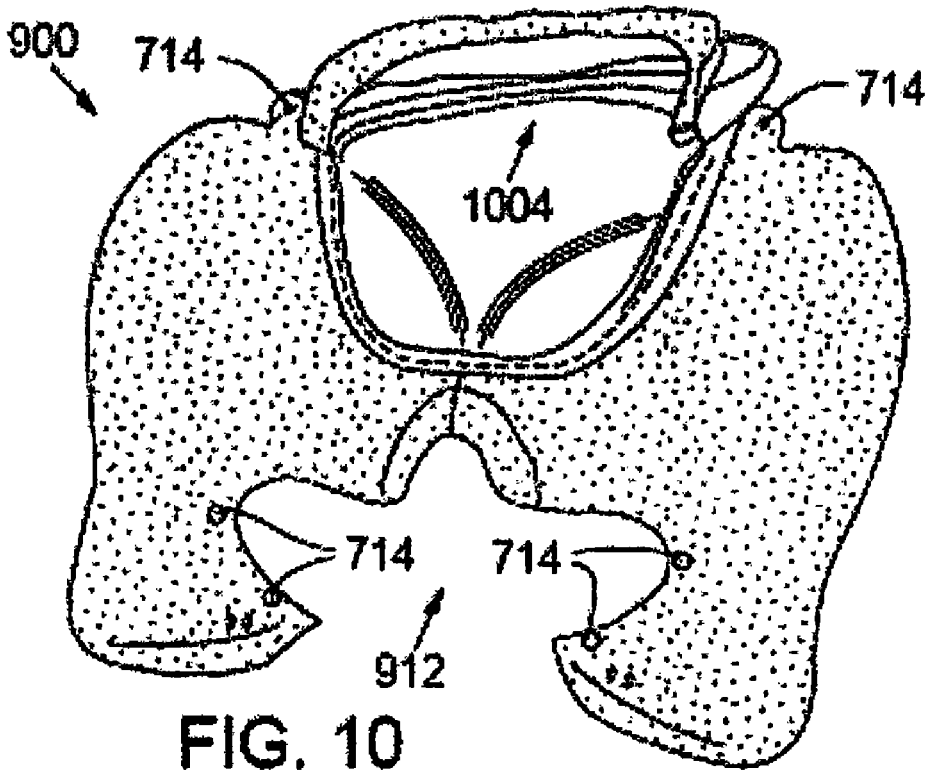
FIG. 10 is a bottom view of the saddle cover in accordance with various embodiments of the present invention.

FIGS. 9 and 10 respectively illustrate a top view and a bottom view of a seat cover 900 in accordance with various embodiments of the present invention. The seat cover 900 may include a jockey portion 904 and a seat portion 908.

The jockey portion 904 may include a pommel cutout 912 configured to fit around the base of the pommel section 212.

The seat portion 908 may include a cantle cavity 1004, on its underside, configured to fit over the cantle 404. In some embodiments, the seat portion 908 may also include one or more layers of padding.

The seat cover 900 may be secured to the saddle structure 400 by panel straps 712 and fastening devices being directed through respective panel strap apertures 140 and fastening apertures 714.

The seat cover 900 may be constructed of a high quality, relatively lightweight material such as, but not limited to, e.g., full grain leather, to provide a refined look and a soft feel to the saddle. In some embodiments, the jockey portion 904 may be of a first type of material and the seat portion 908 may be of a second type of material.

Figure 11:
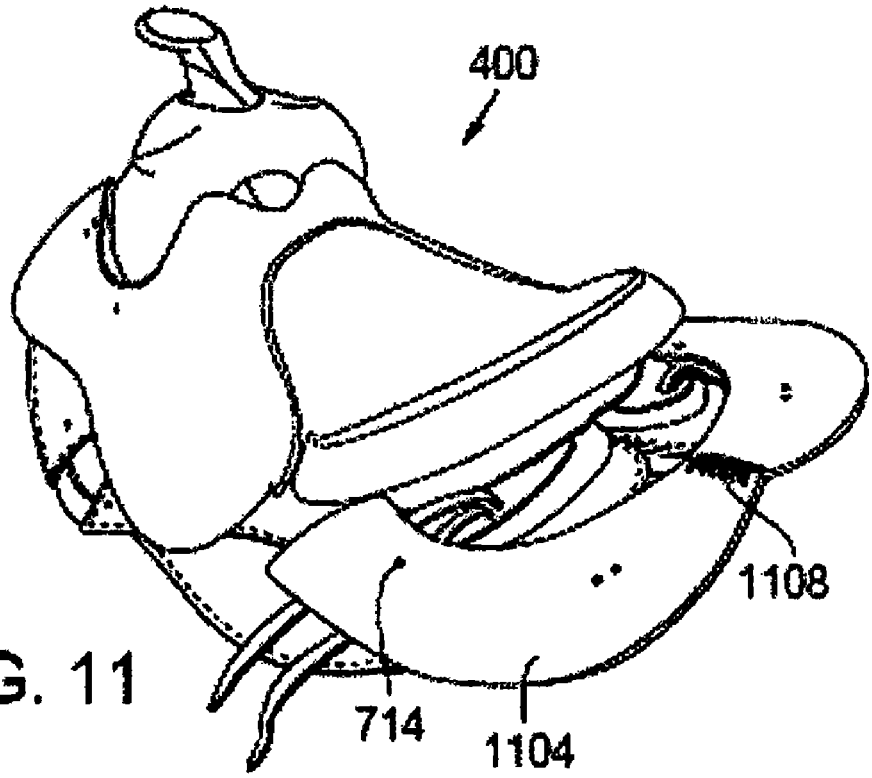
FIG. 11 is a partially exploded view of a rear jockey being coupled to the saddle structure in accordance with various embodiments of the present invention.
Figure 12:
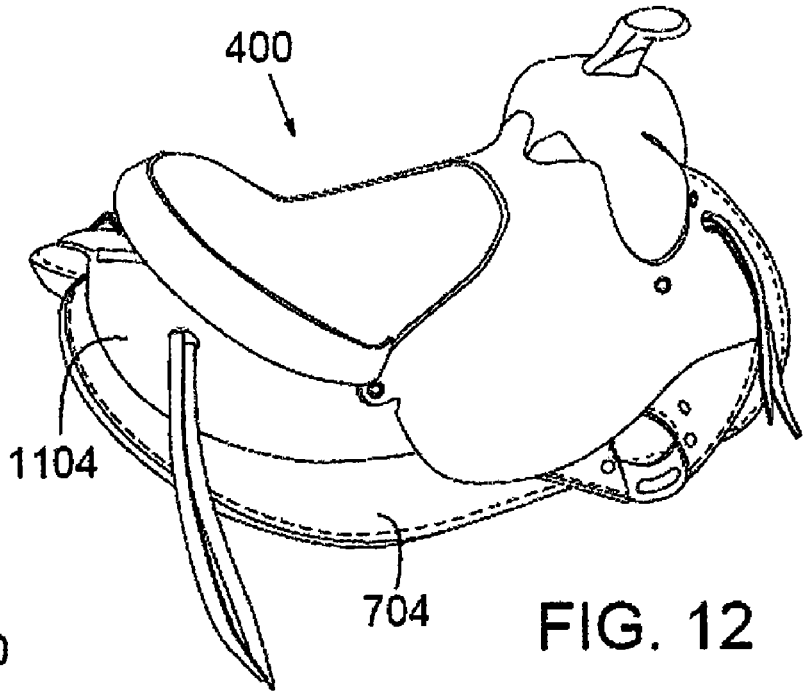
FIG. 12 is a combined view of the rear jockey and the saddle structure.

FIGS. 11 and 12 respectively illustrate an exploded and combined view of the saddle structure 400 including a rear jockey 1104 in accordance with various embodiments of the present invention. The rear jockey 1104 may be positioned behind the cantle 404 and over the back end of the saddle structure 400. The forward portion of the rear jockey 1104, having fastening apertures 714, may be tucked underneath the jockey portion 904 of the seat cover 900 and secured to the saddle structure 400 by the same fastening devices securing the jockey portion 904 to the saddle structure 400.

The rearward portion of the rear jockey 1104 may be secured to the saddle structure 400 by the panel straps 712 routed through panel strap apertures 140.

In some embodiments, the rear jockey 1104 may be constructed of two symmetrical pieces coupled, e.g., sewn, together at a seam 1108. In other embodiments, a single piece may be used for the rearjockey 1104.

Figure 13:
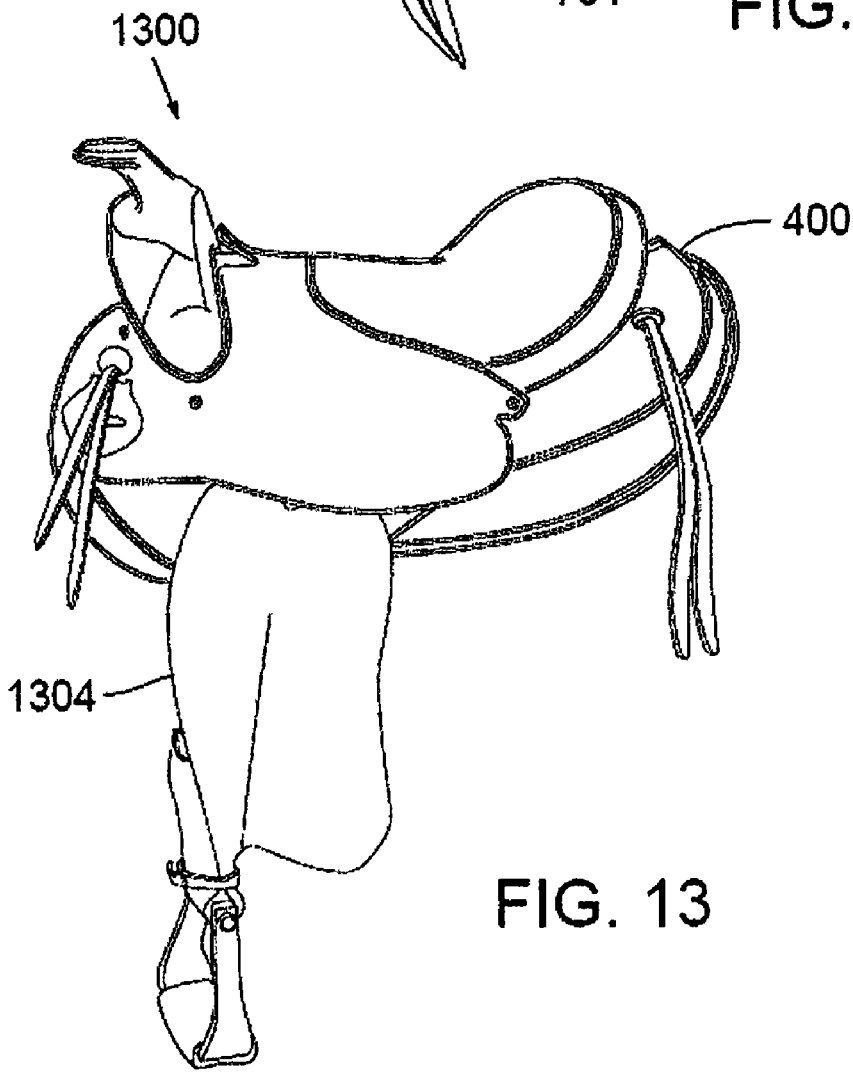
FIG. 13 is a side view of a saddle in accordance with various embodiments of the present invention.

FIG. 13 illustrates a flexible, treeless saddle 1300 in accordance with an embodiment of the present invention. In this embodiment, a stirrup assembly 1304 may be coupled to the saddle structure 400 through stirrup leather apertures of the portion 104. The attachment point of the stirrup assembly 1304 to the saddle structure 400 may be covered by the jockey portion 904.

The assembled saddle 1300 as described in embodiments of the present invention may provide the support and stability previously associated with saddles having rigid saddletrees without the shortcomings associated with prior art saddles as identified above.

Although specific embodiments have been illustrated and described herein, it will be appreciated by those of ordinary skill in the art and others, that a wide variety of alternate and/or equivalent implementations may be substituted for the specific embodiment shown and described without departing from the scope of the present invention. This application is intended to cover any adaptations or variations of the embodiment discussed herein. Therefore, it is manifested and intended that the invention be limited only by the claims and the equivalents thereof.

We claim:

1. A saddle comprising:

a flexible substrate;

a flexible base coupled to an underside of the flexible substrate;

a seat section integrally formed in the flexible substrate;

a pommel section integrally formed in the flexible substrate;

wherein the flexible base comprises a pair of stirrup apertures formed in a lateral side of the flexible base;

wherein the pair of stirrup apertures comprises an upper stirrup aperture and a lower stirrup aperture; and wherein the underside of the flexible substrate comprises a cavity formed in a lateral side of the underside of the flexible substrate, the cavity to extend substantially from the upper stirrup aperture to at least substantially the lower stirrup aperture.

2. The saddle of claim 1, the cavity to substantially accommodate a stirrup extending from the upper stirrup aperture and through the lower stirrup aperture.

* * * * *